US005743410A

United States Patent [19]

Stadtmuller

[11] Patent Number: 5,743,410

[45] Date of Patent: Apr. 28, 1998

[54] SUPRACONDUCTING MAGNETIC SEPARATOR

[75] Inventor: Adam Antoni Stadtmuller, Chalfont St. Peter, Great Britain

[73] Assignee: Carpco, Inc., Jacksonville, Fla.

[21] Appl. No.: 535,019

[22] PCT Filed: May 9, 1993

[86] PCT No.: PCT/GB94/00990

§ 371 Date: Apr. 1, 1996

§ 102(e) Date: Apr. 1, 1996

[87] PCT Pub. No.: WO94/26418

PCT Pub. Date: Nov. 24, 1994

[30] Foreign Application Priority Data

May 7, 1993 [GB] United Kingdom ..... 9309426

[51] Int. Cl.[6] ..... B03C 1/00

[52] U.S. Cl. ..... 209/213; 209/215; 209/223.1; 209/636

[58] Field of Search ..... 209/213, 215, 209/223.1, 223.2, 224, 636; 210/222, 223; 335/216

[56] References Cited

U.S. PATENT DOCUMENTS 4,208,278 6/1980 Stekly ..... 209/223.1
4,290,528 9/1981 Stekly ..... 209/223.1
4,702,825 10/1987 Selvaggi et al. ..... 209/224
5,019,247 5/1991 Purcell et al. ..... 209/224

FOREIGN PATENT DOCUMENTS 1599827 10/1981 United Kingdom ..... B01D 35/06

OTHER PUBLICATIONS

IEEE Transactions on Magnetics., vol. 24, No. 2, Mar. 1988, New York US pp. 745–748, J. Kopp.

Cryogenics., vol. 16, No. 10, Oct. 1976, Guildford GB, pp. 579–582, J.A. Good et al.

*Primary Examiner*—David H. Bollinger
*Attorney, Agent, or Firm*—Arthur G. Yeager

[57] ABSTRACT

A super-conducting magnet includes a vessel (8) defining a separation zone through which material to be separated passes. The magnet includes a super-conducting coil (4) located in the vessel and surrounding the separation zone for providing a magnetic field therein. A tube (6) holds the coil and liquid helium to provide a liquid helium reservoir around the coil. At least one radiation shield (12) is positioned between the tube and the vessel. The magnet is a closed system with no helium circulation from the reservoir to outside the vessel and back and the tube is sized to provide a reservoir of sufficient capacity for operation without helium addition for a number of months, preferably a year. A helium reliquifier (46) is positioned in the neck assembly (16), and a non-return valve (49) is located on the neck assembly for release of helium gas from the reservoir.

11 Claims, 3 Drawing Sheets

SUPRACONDUCTING MAGNETIC SEPARATOR

This invention relates to magnetic separation devices, in particular to the type of device in which magnetic particles are removed from a stream of material by feeding the stream on or through stationary magnetic material, the magnetic particles being held or "trapped" by the magnetic material and therefore extracted from the stream.

One form of magnetic separation device which functions by magnetic particle entrapment is generally referred to as a High Gradient Magnetic Separator or HGMS. An HGMS comprises a canister containing a liquid-permeable packing of magnetizable material between the canister inlet and outlet. The packing material may be paramagnetic or ferromagnetic and may be in particulate or filamentary form, for example, it may comprise wire wool, wire mesh, knitted mesh or steel balls. The packing may be in the form of a single block which essentially fills the canister or it may be in other forms, for example, concentric cylinders or rectangular plates. The term "matrix" is generally employed to refer to the packing and this is used, in the case where the packing is divided into a number or elements, by some in the industry to refer to the individual elements and by others to refer to the totality of the packing. The term will be employed herein in the latter way.

The canister is surrounded by a magnet which serves to magnetize the matrix contained therein, the magnet generally being arranged to provide a magnetic field in the direction of the cylindrical canister axis. With the matrix magnetized, a slurry of fine mineral ore, for example clay dispersed in water, is fed into the inlet of the canister. As the slurry passes through the canister, the magnetizable particles in the slurry are magnetized and captured on the matrix. Eventually, the matrix becomes substantially filled with magnetizable particles and the rate of capture deceases so that the quantity of magnetizable particles in the treated slurry leaving the outlet of the canister reaches an unacceptably high level. The slurry feed is then stopped and the canister rinsed with water to remove all non-magnetic material from the matrix. The magnetic field acting on the matrix is reduced to a sufficiently low value to enable the magnetic material to be washed off the matrix elements with a high speed stream of water.

The magnetic field may be reduced by de-energizing the magnet. HGMS systems operated in this way are referred to as switched HGMS systems.

De-energization, washing and subsequent re-energization is however inefficient as regards cycle time and power consumption. Accordingly, an arrangement has been developed in which the magnet does not have to be de-energized to enable regeneration of the matrix to be carried out. Instead, two matrix canisters are provided, moved alternately into the separation zone. Thus, as one matrix canister is engaged in separation, the second can be flushed and the matrix regenerated. HGMS systems operated in this way are referred to as reciprocating canister HGMS systems or RCHGMS systems.

The magnetic field required for a switched HGMS or an RCHGMS can be provided by an electromagnet operating at ambient temperatures, a permanent magnet or a superconducting magnet operating at cryogenic temperatures. Cryogenic magnets for use with a switched HGMS or a RCHGMS in industrial applications include a close coupled helium liquefaction system which has sufficient cooling power to maintain the magnet coil below the critical superconducting temperature. The coil is held in a reservoir of liquid helium which is surrounded by one or more radiation shields, the whole being contained in a cryostat vessel. The shields are maintained at low temperatures by refrigeration means which may include cooling pipes for circulating liquid nitrogen and/or cryocoolers.

As there is a large temperature difference T between the helium in the reservoir and the exterior of the cryostat vessel, which is at room temperature, about 300° K., even with the shielding the energy losses E are high since $E \alpha T^4$. For this reason a refrigerator and/or a helium liquefier is provided for the helium in the reservoir.

A switched HGMS is described in U.S. Pat. No. 5,019,247. The arrangement is intended to reduce cryogenic consumption. However, a helium liquefier and a continuous supply of liquid nitrogen are required for continuous operation of the magnet described therein.

An arrangement for an RCHGMS has been proposed in the paper entitled, "Developments in super-conducting magnetic separation for commercial application" presented by A. A. Stadtmuller et al. at the eighth "Industrial Minerals" International Congress. The system employs closed cycle refrigeration in the form of a refrigerator bolted directly to the reservoir thus dispensing with a dedicated separate liquefier. However in essence a helium liquefier is still provided but is built-in rather than separate as the system is an open one which causes circulation of helium from the reservoir to the refrigerator and vice versa.

All super-conducting magnets employed in industrial HGMS systems, whether switched or reciprocating canister, include a dedicated helium liquefier, either attached or separate and so are open systems with the helium constantly being circulated to and from the liquefier. Liquefiers have certain drawbacks however, most notably, that the magnet and hence the separator as a whole is substantially dependent on their continued operation. Stoppage can result from a variety of causes including mechanical failure, power failure, motor failure or blockage in the helium pipe work due to minute quantities of impurities. The cryogenic system of a liquefier is generally sized for normal low temperature operation because of cost and energy considerations and is substantially less effective in initial cool down. Consequently, a relatively short stoppage can result in a substantially longer delay in the separator being available for operation.

All liquefiers need supervision and maintenance. For a continuously operating plant, the necessary supervision will involve regular checks by a trained operator which will have an adverse effect on running cost. Maintenance of a liquefier involves periodic stop pages for services by skilled engineers which results in plant down-time. A liquefier system is also technically complex since it requires coupling of a number of components including one or more compressor packs, helium gas storage containers, a liquid helium storage container, a helium purification pack and the liquefier module. Provision of a liquefier therefore has a substantial impact on the operation and installation cost of a HGMS system both in terms of the skilled manpower and specialized equipment needed as well as the space required.

British Patent 1599827 describes a RCHGMS including a magnet comprising a super-conducting coil held in a liquid helium reservoir. The liquid helium is supplied by a suitable continuous liquification plant so that there is, in use, continual circulation of helium to and from the magnet. The Patent, therefore, provides a separator of the known type discussed above which consequently exhibits the disadvantages of that known separator type.

J Kopp, in an article entitled "Super-conducting Magnetic Separations" which appeared in IEEE Transactions on Magnetics, 24 (1988) Mar., No. 2, New York, U.S., discusses the problems found in use with super-conducting separators. He describes that the small number of industrially sized separators known at the time all included separate helium reliquifiers. Bath cooling is, according to the article, suitable for laboratory scale separators but where employed in industry, this is in conjunction with a separate refrigerator.

In accordance with the invention, a separator having a separation zone and at least two separating chambers containing liquid permeable magnetisable separating packing alternately positionable in the separation zone, and, a super-conducting magnet comprises a vessel defining the separation zone, a super-conducting coil located in the vessel and surrounding the separation zone for providing a magnetic field therein, a tube for holding the coil and liquid helium to provide a liquid helium reservoir around the coil, at least one radiation shield between the tube and the vessel and electric circuit means connected to the coil via current leads for energising the coil, wherein the vessel includes a neck assembly through which the current leads pass to the coil and via which the reservoir is supplied with liquid helium, characterised in that, in use, the neck assembly is closed to passages of liquid helium such that the magnet defines a closed system with no helium circulation between the reservoir and the exterior of the vessel and in that the tube is sized to provide a reservoir of sufficient capacity for operation without helium addition to the magnet for a number of months.

With such a separator, the need for a dedicated helium liquefier is dispensed with. This is achieved by refrigerating the super-conducting coil by emersion in a large reservoir of liquid helium. By dispensing with a separate helium liquefier, costs are reduced and magnet operation is rendered effectively independent of the plant power supply, since if the power supply fails, the magnet will continue to function. Further, the thermal losses associated with the magnet are preferably reduced so that there is minimal liquid helium boil off.

The rate at which liquid helium is lost from the reservoir by evaporation or "boiling off" is dependent on the surface area of the liquid helium reservoir. The size of any reservoir is dictated by the size of the super-conducting coil to be contained therein. In industrially sized systems with a cylindrical coil, and thus a cylindrical reservoir, the bore may have a diameter, for example, of between 300 mm and 1 m. With heat losses minimised to, say, below 100 mW, the helium boil off is such that reservoirs will be between 60–150 cc/hr, i.e., 500 to 1500 liters per year. Thus for a hold time, i.e., the time to refill, of six months, the reservoir should have a size of at least 0.25 to 0.75 $m^3$, whilst for a hold time of a year, its size should be 0.5 to 1.5 $m^3$.

The hold time should be at least six months and preferably one year.

Preferably, heat loss minimisation is achieved, at least in part, by use of current leads for the coil which are removably connected to the coil. The current leads may be retractable metal current leads.

The separator, which is a RCHGMS, has the magnet continuously energized because separation is nearly continuously carried out. Once the magnet is energised and the super-conducting switch across the coil closed, the current leads are not required. It has been found that some of the largest heat losses occur via the current leads. Consequently their removal during the majority of separator operations significantly reduces heat losses and therefore helium boil off.

In the event that the magnet must de-energized, for example, for complete removal of the separating chamber or chambers, the amount of helium lost by brief current lead insertion and magnet de-energization is insignificant.

Alternatively high-temperature super-conductor current leads are employed which are permanently connected but held at a temperature below their super-conductivity transition temperature with the result that their thermal conductivity will be very low and so too will be the heat loss therefrom.

In either case, the leads pass through the neck assembly of the tube via which boiled-off helium gas exits through a non-return vent valve. The gas serves to cool the neck assembly.

Preferably a support structure is provided for the coil and/or tube, the material of which has high strength and low thermal conductivity. Suitable materials include fibre glass or carbon fibres bonded with epoxy and ceramics. Again it has been found that the support rods, which normally constitute a large part of known magnet support structures, are responsible for significant heat losses. By forming these from low thermal conductivity materials, heat loss reduction is achieved.

The radiation shields produce a reduction in the heat losses from ambient temperature radiation. Cooling of the radiation shields and interception of the heat load down the tie rods is suitably effected by using conventional cryocoolers based on Gifford, McMahon or Solvay thermodynamic cycles. Additionally, or alternatively, the shields may be cooled by means of liquid nitrogen.

A small sized helium reliquefier may be provided in the filling neck Of the magnet for reliquefying helium gas boiled-off from the reservoir. With known arrangements, the helium gas entering the separate liquefier is at or near room temperature due to heat losses during passage of the gas along the connecting pipe Work and through the purification system. The gas in the above described magnet will, in contrast, be at much lower temperatures, for example that of the shield. Thus only a small reliquefier will be required to liquify boiled-off helium. The provision of a reliquefier for recondensing helium in situ will mean that, for a given reservoir size, the time between refills will be longer and, for a given desired operational time between refills, reservoir size can be decreased.

The reliquefier can suitably be a cryocooler with an expansion state and can be located in the neck passage via which the tube is filled with helium.

The invention will now be further described by way of example with reference to the accompanying drawings in which.

Figure 6:
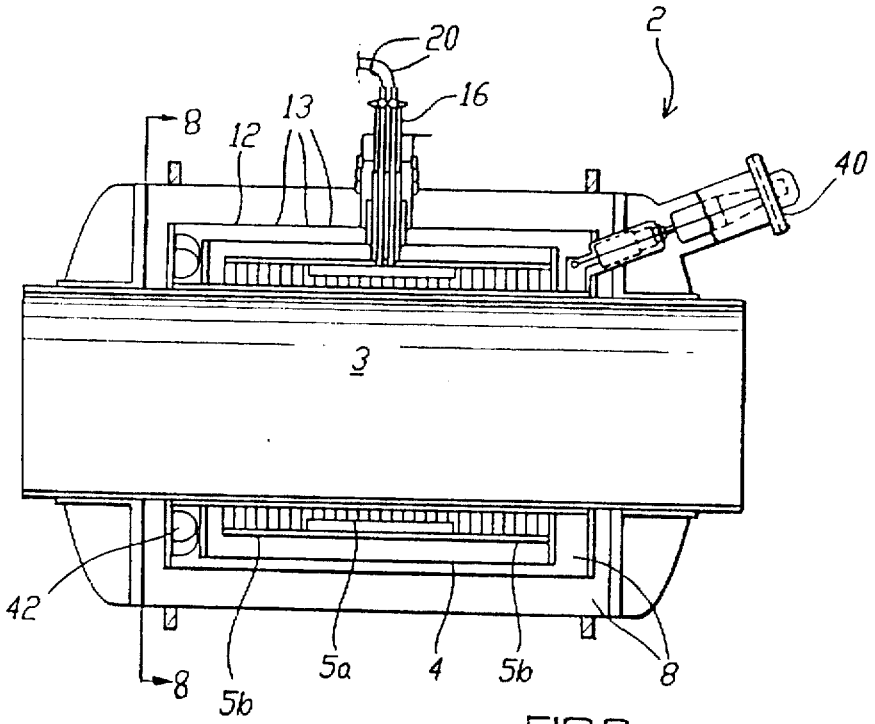
FIG. 6 is a longitudinal sectional view of a magnet in accordance with the invention illustrating the support structure.

The magnet 2 comprises a central bore 3 and a semiconductor solenoid 4 held in a tube 6 surrounding the bore 3 which act as a helium reservoir. The semiconductor solenoid 4 comprises one or more coils wound from a super-conductor consisting of filaments of super-conducting alloy. As shown in FIG. 6, the solenoid may comprise central coils 5*a* and outer coils 5*b*, the outer coils 5*b* having a greater number of windings than the central coils 5*a* in order to compensate for fall off of magnetic field intensity near the ends of the solenoid 4. The tube 6 is in turn enclosed in a cryostat vessel 8. Between the vessel 8 and tube 6, two radiation shields 10, 12 are provided. A cryocooler 14 serves to maintain the shields 10, 12 at suitable temperatures, for example 46K for inner shield 10 and 60K for outer shield 12. Alternatively, or additionally, as illustrated in FIG. 6, the shields 10, 12 may be cooled by tubes 13 carrying liquid nitrogen.

A neck assembly 16 extends through cryostat vessel 8 and shield 10, 12 to tube 6. The neck assembly 16 includes electrical leads 20 for the solenoid 4 and provides a siphon insert point for filling of tube 6 with helium. It will also serve as a location for a helium reliquefier, if one is provided.

The leads 20 are arranged such that heat losses due thereto are substantially eliminated. These may be as high as 7.2 Watts for a 0.28 meter bore RCHGMS. In view of the fact that 1 Watt of heating will vaporize approximately 1.4 liters of liquid helium, it will be appreciated that elimination of heat losses via the current leads will result in a significant reduction in helium boil off.

The leads 20 may be made from metal, such as copper, brass, aluminium or stainless steel. Such metal leads will have high thermal conductivity and, therefore, to reduce heat loss the leads 20 must be removable out of the liquid helium space 6 to reduce thermal conduction.

Figure 1:
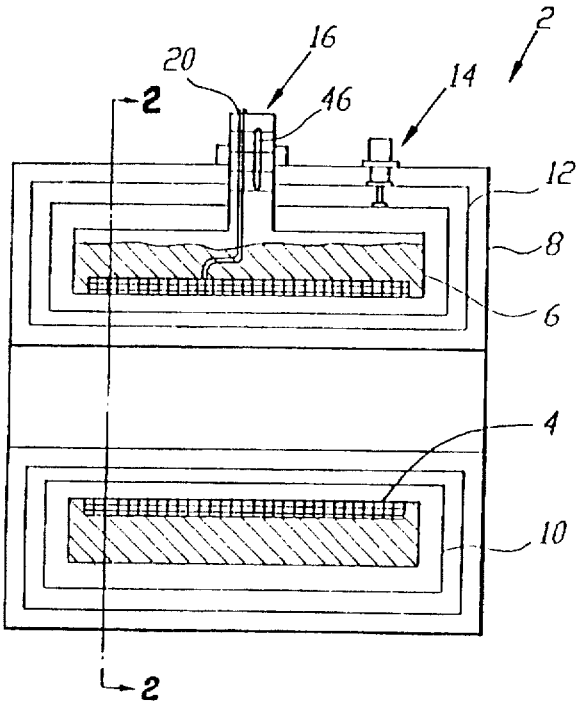
FIG. 1 is a schematic side sectional view of a magnet in accordance with the invention.
Figure 2:
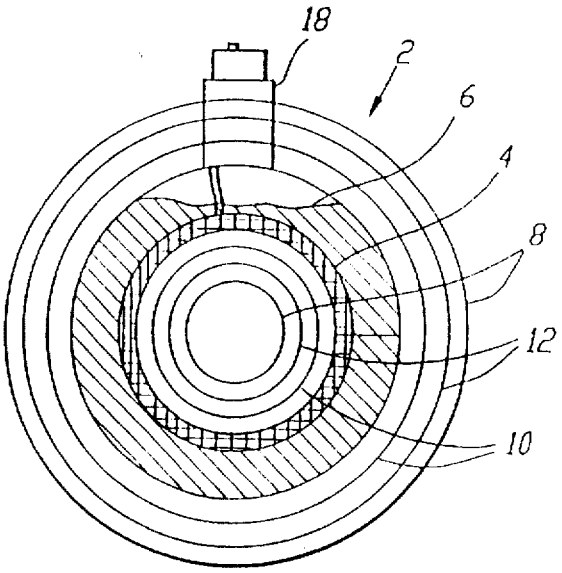
FIG. 2 is a view taken along the line 2—2 of FIG. 1.
Figure 3:
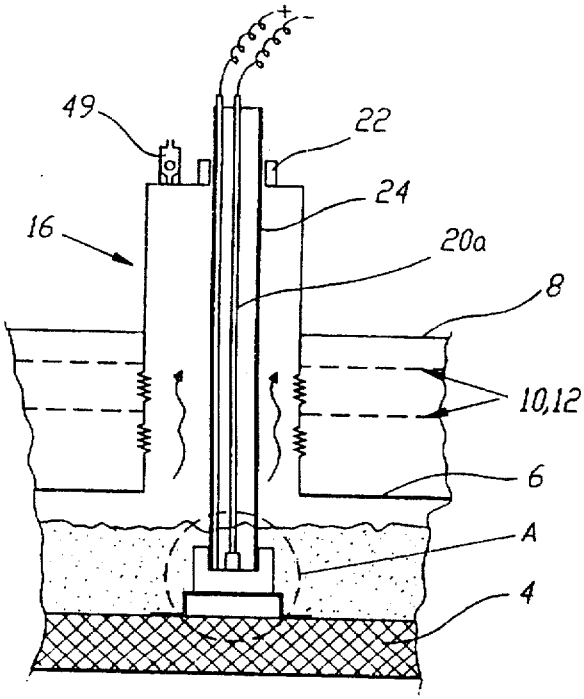
FIG. 3 is an enlarged view of one embodiment of the electrical connection of the magnet of FIG. 1.
Figure 4:
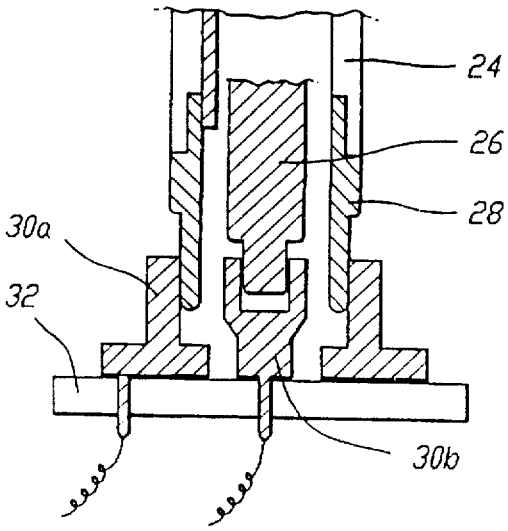
FIG. 4 is an enlarged view of the encircled portion A of FIG. 3.

FIGS. 3 and 4 illustrate a suitable arrangement for retractable metal current leads 20*a*. The leads 20*a* are guided into and out of the helium reservoir 6 by a guide sleeve and seal 22 and a hollow insulating guide tube 24. At the base of the tube 24, the leads 20*a* protrude therefrom to define a central plug 26 and an outer annular conductor plug 28. A socket 30 with an outer annular section 30*a* and a central section 30*b* is mounted via an insulating base 32 to the coil 4. Either the plug defined by protruding portions 26, 28 and or the socket 30 has spring-loaded fingers to ensure good electrical contact. The arrangement is similar to a common domestic plug.

Figure 5:
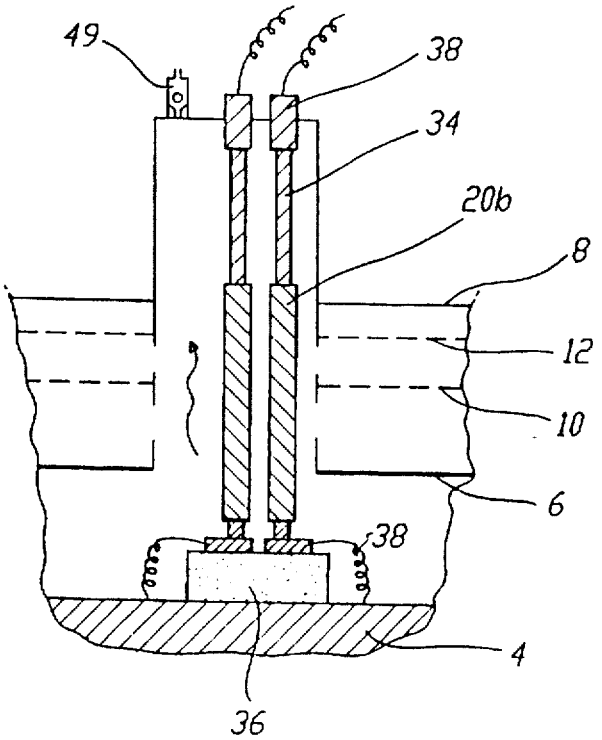
FIG. 5 is an enlarged view of an alterative embodiment of the electrical connection of the magnet of FIG. 1.

Alternatively, high temperature ceramic super-conductor current leads 20*b* may be employed and a suitable arrangement therefor is illustrated in FIG. 5. High temperature ceramic super-conductors have very low thermal conductivities when cooled below the super-conducting transition temperatures thereof. Consequently, current leads 20*b* made from such materials can be permanently connected with the helium reservoir 6 and will still give minimal liquid helium boil off. The leads 20*b* must be positioned within the neck assembly 16 and reservoir 6 such that their temperature is below the super-conducting transition temperature which may be, for example 77° K. The leads 20*b* are connected to the power supply via metal conductors 34 at both ends, the conductors 34 adjacent the solenoid 4 being secured to an insulator block 36. Connecting wires 38 extend between the conductors 34 and the power supply and the solenoid 4.

Helium gas boiled off from the reservoir will pass through the neck assembly 16, as shown by the arrows of FIGS. 3 and 5. That gas will, therefore, serve to cool the leads 20 and, in the case of ceramic super-conductor leads 20*b* will help maintain these below the transition temperature and thus ensure that they exhibit low thermal conductivity.

Figure 7:
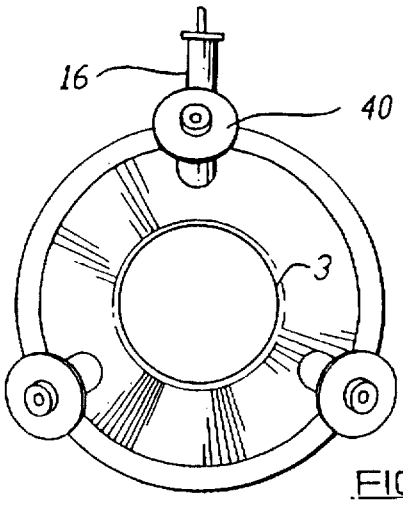
FIG. 7 is an end view of the magnet of FIG. 6.
Figure 8:
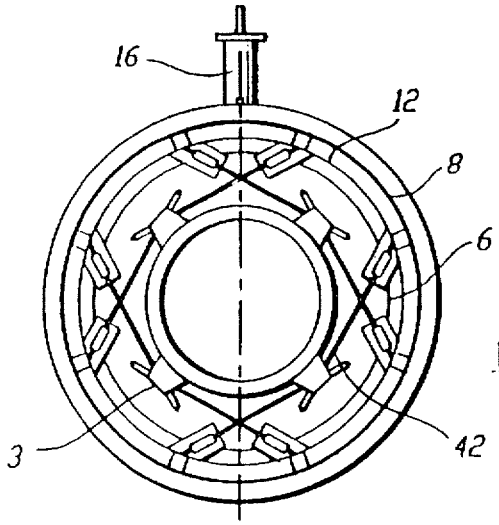
FIG. 8 is a cross-sectional view through the magnet of FIG. 6 taken along the line 8—8 of FIG. 6.

The tube 6 is mounted by a support structure, one suitable form for which is illustrated in FIGS. 6 to 8. The support structure, which serves to suspend the tube 6 in the cryostat vessel 8 comprises three substantially rigid struts 40 arranged in a tripod formation at one end. At the other end, the tube 6 is supported by rods 42 which are relatively flexible and arranged in the manner of the spokes of a wire wheel in order to accommodate radial and longitudinal expansion and contraction of the tube 6. The support structure, whether comprising the struts 40 and rods 42 as illustrated, or taking some other form, is suitably formed of high strength, low thermal conductivity material such as fibre glass or carbon fibres bonded with epoxy or other ceramics. Heat losses with a titanium support structure can be 3 Watts for a 0.28 bore RCHGMS. Use of a low thermal conductivity material for the support structure will therefore again substantially reduce helium boil off.

With the above described arrangement, heat losses can be reduced to less than 70 mW in a magnet having a bore of 1 meter diameter and an axial length of more than 1 meter giving a liquid helium boil off rate of less than 100 cc per hour. Consequently a liquid helium reservoir of 1 $m^3$ will not require replenishing in less than 10,000 hours or in excess of one year. The reservoir formed by tube 6 will therefore, if of 1 $m^3$ capacity, need refilling only every year or so. This is easily accomplished, involves minimum down time (typically 2 to 4 hours) and does not require the separator to be shut down.

It will be appreciated that the tube 6 will be dimensioned to give a helium reservoir size appropriate to the actual heat losses associated with a particular magnet size.

The magnet 2 therefore does not require a helium liquefier. This results in many advantages. Firstly, the technical complexity of the separator system including magnet 2 is substantially reduced. This will give increased reliability of operation as well as reduced manufacturing and operating cost. The design is more energy efficient because the thermal losses associated with external cryogenic pipe work are eliminated. Electrical power running costs are a fraction of those associated with separators incorporating a liquefier. The magnet 2 is much less sensitive to electrical power failure than liquefier based systems. A typical annual service will, as noted above, involve a liquid helium refill and a change of the cryocooler. Neither of these operations demand that operation of a separator incorporating magnet 2 be stopped.

A minimal size helium reliquefier 46 may, however, be provided in the neck assembly 16. The liquefier 46 will be held at a low temperature by virtue of its position. Thus helium gas entering the liquefier will also be at a relatively low temperature and, therefore, the small liquefier 46 will be capable of reliquefying this gas.

Alternatively, or additionally, a non-return helium gas vent valve 49 may be provided for neck assembly 16, as shown in FIGS. 3 and 5.

Figure 9:
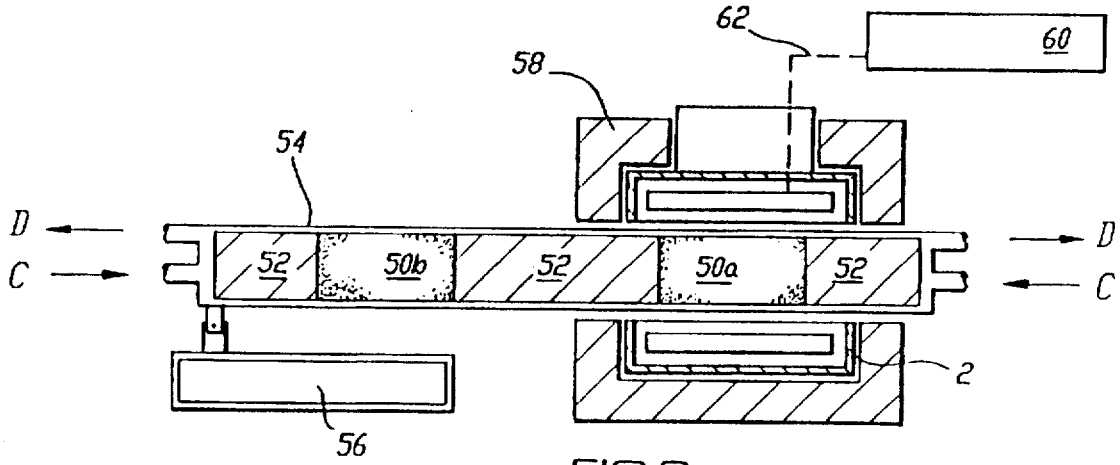
FIG. 9 is a schematic view of a magnetic separator incorporating the magnet of FIG. 1 or FIG. 6.

The magnet 2 can be employed in a separator 48, shown schematically in FIG. 9. The separator comprises two separating canisters 50 sandwiched between three compensating canisters 52. The canisters 50, 52 define together a reciprocating matrix train 54 which is moved by a linear actuator 56. The arrangement allows a first separating canister 50*a* to be actively engaged in the separation process whilst the second separating canister 50*b* is outside the high field region created by the magnet 2. The second separating canister 50*b* can, therefore, be flushed clean of previously captured magnetic particles. The reciprocating matrix train 54 is periodically moved such that a regenerated separating canister 50 enters the high field region whilst the previously active separating canister 50 is moved out for regeneration. Material to be separated is fed in the direction of arrow C whilst the separated products exits in the direction of arrow D.

The magnet 2 is surrounded by an iron yoke 58. This reduces the external magnetic field which allows a short canister train 54 to be used and eliminates any hazards to personnel working in the vicinity of the magnet.

The power supply for the magnet is shown schematically at 60 whilst the connections to leads 2 extending to the magnet 2 are shown at 62.

I claim:

1. A separator (48) comprising a vessel (8) defining a separation zone and at least two separating chambers (50) containing liquid permeable magnetisable separating packing alternately positionable in said separation zone, a super-conducting magnet (2), a super-conducting coil (4) located in said vessel (8) and surrounding said separation zone for providing a magnetic field therein, a tube (6) for holding said coil (4) and liquid helium to provide a liquid helium reservoir around said coil (4), at least one radiation shield (10, 12) between said tube (6) and said vessel (8), and electric circuit means connected to said coil via current leads (20) for energising said coil, said vessel (8) including a neck assembly (16) through which said current leads (20, 20*a*, 20*b*) said pass to said coil (4) and via which the reservoir is supplied with liquid helium, characterised in that, in use, said neck assembly (16) is closed to passage of liquid helium such that said magnet (2) defines a closed system with no helium circulation between said reservoir and the exterior of said vessel (8), and in that said tube (6) is sized to provide a reservoir of sufficient capacity for operation without helium addition to said magnet (2) for a number of months, and wherein a helium reliquefier (46) is positioned in said neck assembly (16).

2. A separator as defined in claim 1 wherein a non-return valve (49) is located on said neck assembly (16) for release of helium gas from said reservoir.

3. A separator as defined in either claim 1 or claim 2 wherein said current leads (20*a*) are removably connected to said coil (4).

4. A separator as defined in either claim 1 or claim 2 wherein said current leads comprise low temperature ceramic super-conductor lead sections (20*b*).

5. A separator as defined in either claim 1 or claim 2, wherein a support structure (40, 42) maintains said coil (4) and tube (6) within said vessel (8), said support structure (40, 42) being formed from a material which is high strength and low thermal conductivity.

6. A separator as defined in either claim 1 or claim 2 wherein a support structure (40, 42) maintains said coil (4) and tube (6) within said vessel (8), said support structure (40, 42) being formed from a material which is high strength and low thermal conductivity and selected from the group of glass material, carbon-fibre reinforced plastic material, and ceramic material.

7. A separator (48) comprising a vessel (8) defining a separation zone and at least two separating chambers (50) containing liquid permeable magnetisable separating packing alternately positionable in said separation zone, a super-conducting magnet (2), a super-conducting coil (4) located in said vessel (8) and surrounding said separation zone for providing a magnetic field therein, a tube (6) for holding said coil (4) and liquid helium to provide a liquid helium reservoir around said coil (4), at least one radiation shield (10, 12) between said tube (6) and said vessel (8), and electric circuit means connected to said coil via current leads (20) for energising said coil, said vessel (8) including a neck assembly (16) through which said current leads (20, 20*a*, 20*b*) said pass to said coil (4) and via which the reservoir is supplied with liquid helium, characterised in that, in use said neck assembly (16) is closed to passage of liquid helium such that said magnet (2) defines a closed system with no helium circulation between said reservoir and the exterior of said vessel (8), and in that said tube (6) is sized to pro-vide a reservoir of sufficient capacity for operation without helium addition to said magnet (2) for a number of months, and wherein a non-return valve (49) is positioned on said neck assembly (16) for release of helium gas from said reservoir.

8. A separator as defined in claim 7, wherein said current leads (20*a*) are removably connected to said coil (4).

9. A separator as defined in claim 7, wherein the current leads comprise low temperature ceramic super-conductor lead sections (20*b*).

10. A separator as defined in any of claims 7, 8 or 9 wherein a support structure (40, 42) maintains said coil (4) and tube (6) within said vessel (8), said support structure (40, 42) being formed from a material which is high strength and low thermal conductivity.

11. A separator as defined in any of claims 7, 8 or 9 wherein a support structure (40, 42) maintains said coil (4) and tube (6) within said vessel (8), said support structure (40,42) being formed from a material which is high strength and low thermal conductivity and selected from the group of glass material, carbon-fibre reinforced plastic material, and ceramic material.

* * * * *